US007570170B2

(12) United States Patent
Wallner

(10) Patent No.: US 7,570,170 B2
(45) Date of Patent: Aug. 4, 2009

(54) MONITORING APPARATUS FOR A HELMET

(75) Inventor: Edward J. Wallner, Westfield, IN (US)

(73) Assignee: Delphi Technologies, Inc., Troy, MI (US)

( * ) Notice: Subject to any disclaimer, the term of this patent is extended or adjusted under 35 U.S.C. 154(b) by 785 days.

(21) Appl. No.: 11/147,906

(22) Filed: Jun. 8, 2005

(65) Prior Publication Data

US 2006/0293867 A1 Dec. 28, 2006

(51) Int. Cl.
*G08B 23/00* (2006.01)

(52) U.S. Cl. ..... 340/573.1; 2/417

(58) Field of Classification Search ..... 340/573.1; 2/410, 6.1, 6.6, 411, 417, 421; 180/271
See application file for complete search history.

(56) References Cited

U.S. PATENT DOCUMENTS 3,658,054 A * 4/1972 Iberall ..... 600/485
4,982,452 A * 1/1991 Chaise ..... 2/421
6,003,156 A * 12/1999 Anderson ..... 2/421
6,157,298 A 12/2000 Garfinkel et al.
6,798,392 B2 9/2004 Hartwell et al.

FOREIGN PATENT DOCUMENTS

DE 19934188 12/2000

OTHER PUBLICATIONS

EP Search Report dated Sep. 19, 2006.

* cited by examiner

*Primary Examiner*—Toan N Pham
*Assistant Examiner*—Travis R Hunnings
(74) *Attorney, Agent, or Firm*—Jimmy L. Funke

(57) ABSTRACT

A distributed array of force sensors disposed in the inner lining of a safety helmet measure forces between the inner periphery of the helmet and a user's head, and a microcontroller responsive to the force measurements and other sensor data determines if the helmet fits the user properly. The force sensors are preferably provided at the front, back, sides and top of the inner lining, and the microcontroller compares the measured forces to calibrated threshold values to evaluate and indicate the fit of the helmet.

6 Claims, 3 Drawing Sheets

MONITORING APPARATUS FOR A HELMET

TECHNICAL FIELD

The present invention relates to an electronic monitoring apparatus incorporated into a safety helmet for detecting and alerting the user of improper helmet fit.

BACKGROUND OF THE INVENTION

Safety helmets are routinely worn for various vehicle-related and sport-related activities. Although the helmet is designed to protect the user from head injury, the user remains at risk if the helmet is not worn properly. For example, the helmet may not fit properly, the restraining strap(s) may be unfastened or improperly tensioned, and so forth. The U.S. Pat. No. 6,157,298 to Garfinkel et al. addresses some of these concerns with a safety helmet electronic control module that alerts the user with a prerecorded voice message or warning signal if the chin strap is not fastened or is fastened incorrectly, or if the helmet is situated on the user's head in an unsafe manner. However, a safety helmet can fit improperly even when fastened with a chin strap, and the user may not know what constitutes a proper fit. Accordingly, what is needed is a monitoring apparatus for detecting and alerting the user of improper helmet fit.

SUMMARY OF THE INVENTION

The present invention is directed to an improved safety helmet apparatus for monitoring safety-related parameters including helmet fit and alerting the user of any detected improper usage or fit. A distributed array of force sensors disposed in the inner lining of the helmet monitor the helmet attachment force, and a microcontroller responsive to the force sensors and other sensor data determines if the helmet fits the user properly. In a preferred embodiment, force sensors are provided at the front, back, sides and top of the inner lining, and the microcontroller compares the measured forces to pre-established threshold values to evaluate the fit of the helmet.

DESCRIPTION OF THE PREFERRED EMBODIMENT

Figure 1:
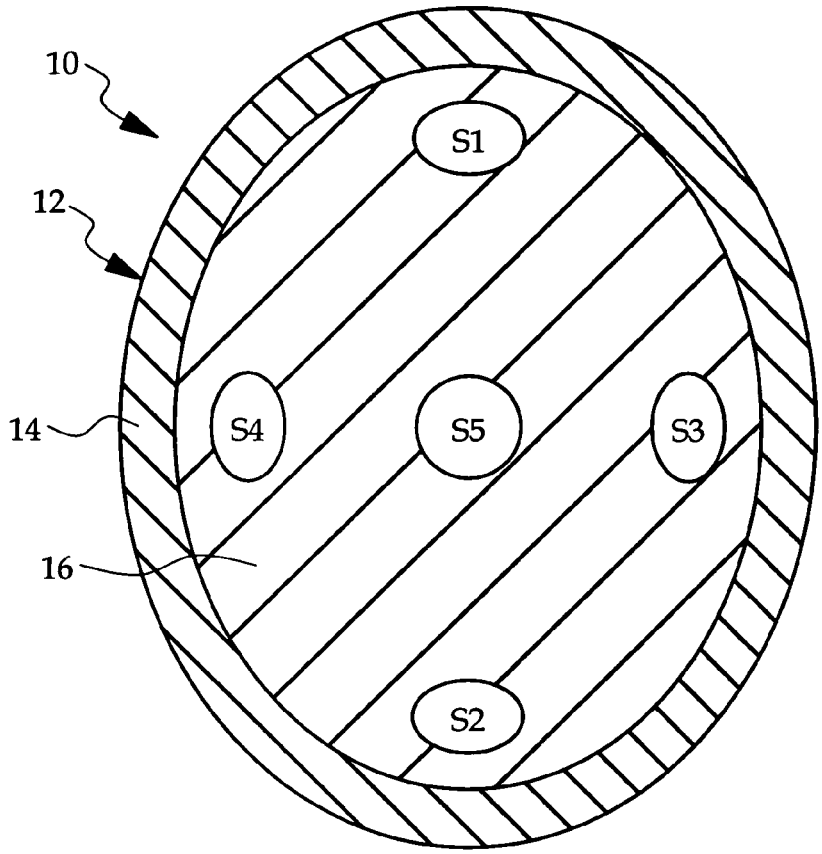
FIG. 1 is a bottom inside view of a safety helmet including an array of force sensors according to this invention.

Referring to FIG. 1, the reference numeral 10 generally designates a safety helmet such as a cycling or sports helmet. The helmet 10 has a hard outer shell 12 covering a layer 14 of energy absorbing material such as polystyrene foam and a fabric lining 16 that contacts the head of a person wearing the helmet 10. An array of thin pressure or force-responsive sensors designated in FIG. 1 as S1, S2, S3, S4 and S5 are mounted between the energy absorbing layer 14 and the liner 16 for measuring contact forces between the inner periphery of helmet 10 and the front, back, sides and top of the user's head. In the illustrated embodiment, the sensors S1-S5 are in the form of variable resistive sensor pads having characteristic electrical resistances that vary with the amount of compressive force applied thereto. Alternatively, piezo-resistive or capacitive sensors can be utilized. It is also possible to implement the invention with a multi-chamber fluid-filled bladder and a set of capacitive or pressure-responsive sensors for indicating the force applied to each chamber. Also, it will be understood that the sensors S1-S5 may be different in number and/or placement than shown in FIG. 1.

Figure 2:
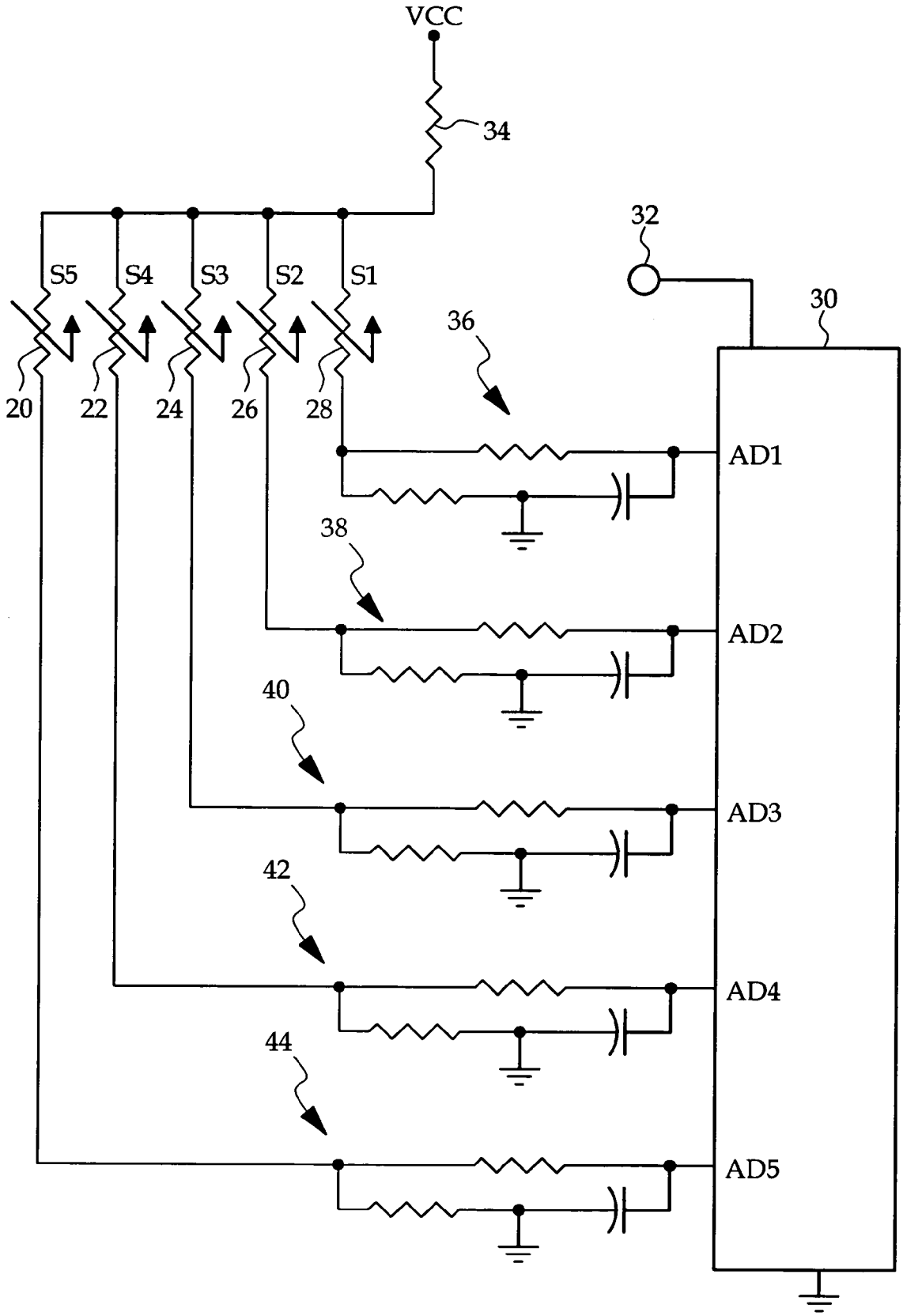
FIG. 2 is a circuit diagram of the force sensors of FIG. 1 and a microcontroller responsive to the sensors.

In the circuit diagram of FIG. 2, the sensors S1, S2, S3, S4 and S5 are represented by the variable resistors 20, 22, 24, 26 and 28, respectively. In general, FIG. 2 is a circuit diagram of a control module mounted in a cavity of the energy absorbing layer 14, for example. The module includes a number of small components mounted on a rigid or flexible circuit board, including a battery (not shown), a microcontroller 30, an alarm or indicator 32 that is visible or audible to the user, and a number of passive elements for interfacing the sensors 20-28 with microcontroller 30. A regulated voltage VCC is coupled to one terminal of each sensor 20-28 via a current-limiting resistor 34, and a set of interface circuits generally designated by the reference numerals 36, 38, 40, 42 and 44 couple the other terminal of each sensor 20-28 to analog-to-digital input ports AD1-AD5 of microcontroller 30. In general, each interface circuit 3644 includes passive voltage dividing and filtering elements selected to optimize pressure or force sensing range and noise rejection. Of course, the control module may include additional components such as acceleration-responsive sensors, a low battery indicator and so forth; likewise, the helmet 10 may be equipped with additional sensors for detecting proper use and tensioning of head straps and chin straps, and sensors for detecting the orientation of the helmet 10 on the user's head, for example.

Figure 3:
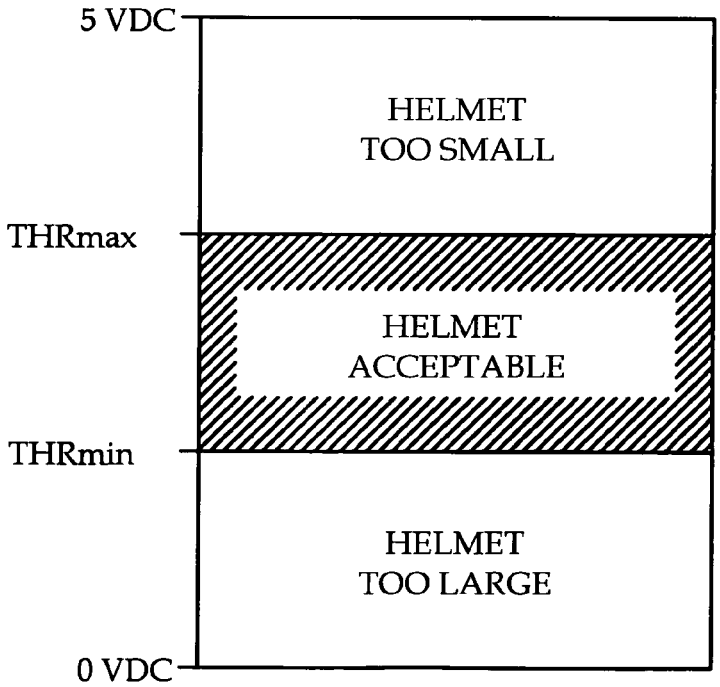
FIG. 3 is a diagram depicting a logic operation carried out by the microcontroller of FIG. 2 according to this invention.

FIG. 3 depicts an easily implemented processing technique utilized by microcontroller 30 in respect to the sensors 20-28. Prior to analog-to-digital conversion, each sensor input is an analog voltage that varies over the range of 0-5 VDC in proportion to the respective sensed pressure. The microcontroller 30 establishes a pair of calibrated thresholds THRmin and THRmax for each sensor location defining a range of input signal variation (shaded in FIG. 3) for which the contact force between the user's head and the energy absorbing layer 14 is consistent with proper fit of the helmet 10. In general, if the sensor input voltage exceeds THRmax, the contact force is too high for a proper fit, indicating that the retaining strap(s) should be loosened or that the helmet 10 is simply too small for the user; and if the sensor input voltage is less than THRmin, the contact force is too low for a proper fit, indicating that the retaining strap(s) should be tightened or that the helmet 10 is simply too large for the user.

Figure 4:
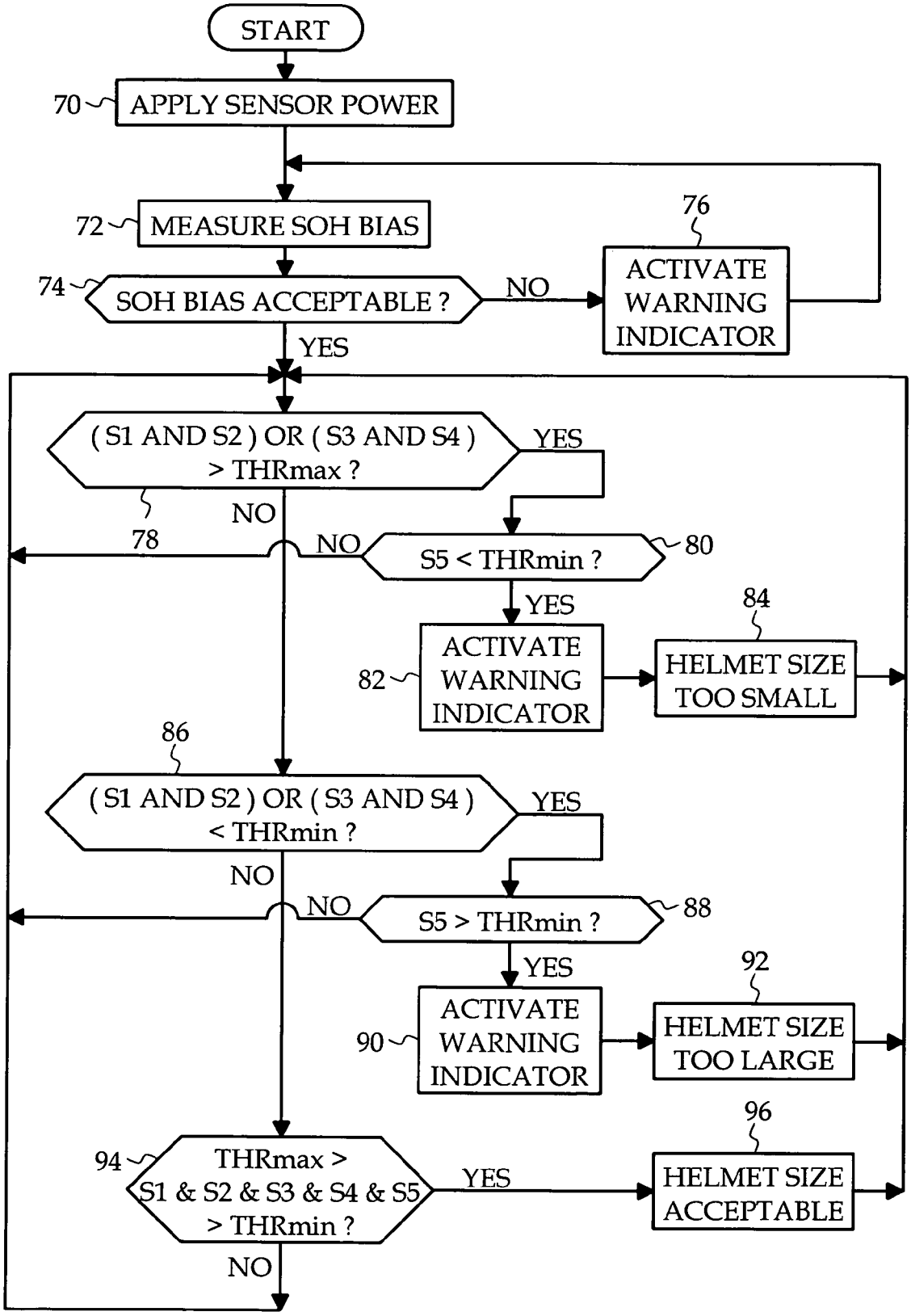
FIG. 4 is a flow diagram of a software routine carried out by the microcontroller of FIG. 2 according to this invention.

The flow diagram of FIG. 4 represents a software routine that is executed by microcontroller 30 according to this invention. The sensors and control module circuitry are powered up at block 70 in response to a user-activated switch or motion sensor. The blocks 72, 74 and 76 are then executed before the helmet 10 is placed on the user's head to measure a bias voltage indicative of the sensors' state of health (SOH) and to indicate a sensor malfunction with warning indicator 32 if the measured bias voltage is out of range. If operability of the sensors S1-S5 is confirmed, the user is prompted (by indicator 32, for example) to put on the helmet 10, and the microcontroller 30 executes the remainder of the routine to compare the sensor readings to the calibrated minimum and maximum thresholds THRmin and THRmax to determine if the helmet fit is proper.

First, the blocks 78-84 check for conditions indicative of a helmet that is too small to adequately protect the user. When the helmet 10 is too small, it will be too snug laterally to provide adequate pressure vertically (i.e., to the top of the user's head), even when the chin strap is fastened and properly tensioned. The block 78 determines if the inputs for front and rear sensors S1 and S2 exceed THRmax, or if the inputs for the side sensors S3 and S4 exceed THRmax. If either or both conditions are true, the block 80 is periodically executed to determine if the input for the top sensor S5 is also less than THRmin. If block 80 is answered in the affirmative, the helmet 10 is considered to be too small to provide adequate protection to the user, and the blocks 82-84 are executed to provide a warning to that effect via indicator 32.

Second, the blocks 86-92 check for conditions indicative of a helmet that is too large to adequately protect the user. When the helmet 10 is too large, it will be too loose laterally even when the chin strap is fastened and properly tensioned, and at the same time too snug vertically, assuming that the chin strap is fastened and properly tensioned. The block 86 determines if the inputs for front and rear sensors S1 and S2 are less than THRmin, or if the inputs for the side sensors S3 and S4 are less than THRmin. If either or both conditions are true, the block 88 is periodically executed to determine if the input for the top sensor S5 is also greater than THRmin. If block 88 is answered in the affirmafive, the helmet 10 is considered to be too large to provide adequate protection to the user, and the blocks 90-92 are executed to provide a warning to that effect via indicator 32.

If blocks 78 and 86 are both answered in the negative, the block 94 is executed to determine if the helmet 10 is properly sized for the user. In this case, all of the sensor readings will be within the shaded portion of the diagram of FIG. 3—that is between THRmin and THRmax. If block 94 determines that this condition is true, the block 96 is executed to provide a suitable indication via indicator 32.

In summary, the present invention provides a simple and convenient way of monitoring for improper fit of a safety helmet, and alerting the user when an improper fit is detected. As mentioned herein, the illustrated apparatus may be used in conjunction with other sensors to provide comprehensive helmet fit and usage monitoring. It will be recognized that numerous additional modifications and variations will occur to those skilled in the art. For example, the described functionality of microcontroller 30 may be performed with discrete circuitry, additional indicators or different types of indicators (a dual-color indicator, for example) may be provided, and so on. Accordingly, it is intended that the invention not be limited to the disclosed embodiment, but that it have the full scope permitted by the language of the following claims.

The invention claimed is:

1. Monitoring apparatus for a safety helmet, comprising:

an array of force-responsive sensors mounted in the helmet for sensing contact forces between an inner periphery of the helmet and a user's head;

a control module mounted in the helmet and coupled to the force responsive sensors for determining if the helmet properly or improperly fits the user's head based on the sensed contact forces; and a warning indicator activated by the control module when improper helmet fit is determined;

wherein said array of force-responsive sensors sense contact forces between the inner periphery of the helmet and a left side, a right side, a top and a back of the user's head.

2. Monitoring apparatus for a safety helmet, comprising:

an array of force-responsive sensors mounted in the helmet for sensing contact forces between an inner periphery of the helmet and a user's head;

a control module mounted in the helmet and coupled to the force responsive sensors for determining if the helmet properly or improperly fits the user's head based on the sensed contact forces; and a warning indicator activated by the control module when improper helmet fit is determined;

wherein said control module compares the sensed contact forces to a pair of calibrated thresholds defining an acceptable range of contact force.

3. The monitoring apparatus of claim 2, wherein:

said away of force-responsive sensors sense contact forces between the inner periphery of the helmet and a left side, a right side and a top of the user's head; and said control module activates said indicator when the contact forces between the helmet and the left and right sides of the user's head are above said acceptable range and the contact force between the helmet and the top of the user's head is below said acceptable range.

4. The monitoring apparatus of claim 2, wherein:

said away of force-responsive sensors sense contact forces between the inner periphery of the helmet and a front, a back and a top of the user's head; and said control module activates said indicator when the contact forces between the helmet and the front and back of the user's head are above said acceptable range and the contact force between the helmet and the top of the user's head is below said acceptable range.

5. The monitoring apparatus of claim 2, wherein:

said away of force-responsive sensors sense contact forces between the inner periphery of the helmet and a left side, a right side and a top of the user's head; and said control module activates said indicator when the contact forces between the helmet and the left and right sides of the user's head are below said acceptable range and the contact force between the helmet and the top of the user's head is above said acceptable range.

6. The monitoring apparatus of claim 2, wherein:

said away of force-responsive sensors sense contact forces between the inner periphery of the helmet and a front, a back and a top of the user's head; and said control module activates said indicator when the contact forces between the helmet and the front and back of the user's head are below said acceptable range and the contact force between the helmet and the top of the user's head is above said acceptable range.

* * * * *